US012379141B2

(12) United States Patent
Terai et al.

(10) Patent No.: US 12,379,141 B2
(45) Date of Patent: Aug. 5, 2025

(54) LIQUID REFRIGERANT SPRAYER AND FALLING LIQUID FILM TYPE EVAPORATOR

(71) Applicant: DAIKIN INDUSTRIES, LTD., Osaka (JP)

(72) Inventors: Kou Terai, Osaka (JP); Mitsuharu Numata, Osaka (JP); Yutaka Shibata, Osaka (JP); Hirokazu Fujino, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 458 days.

(21) Appl. No.: 17/684,033

(22) Filed: Mar. 1, 2022

(65) Prior Publication Data

US 2022/0178595 A1 Jun. 9, 2022

Related U.S. Application Data

(63) Continuation of application No. PCT/JP2020/036170, filed on Sep. 25, 2020.

(30) Foreign Application Priority Data

Sep. 26, 2019 (JP) ..... 2019-175100

(51) Int. Cl.
*F25B 39/02* (2006.01)
*F28D 5/02* (2006.01)
(Continued)

(52) U.S. Cl.
CPC ..... *F25B 39/028* (2013.01); *F28D 5/02* (2013.01); *F28F 9/22* (2013.01); *F25B 2400/23* (2013.01); *F28D 2021/0071* (2013.01)

(58) Field of Classification Search
CPC ..... F25B 39/028; F25B 2400/23; F28D 5/02; F28D 2021/0071; F28F 9/22
See application file for complete search history.

(56) References Cited

U.S. PATENT DOCUMENTS 6,868,695 B1 3/2005 Dingel et al.
10,132,537 B1 11/2018 Stamp et al.
(Continued)

FOREIGN PATENT DOCUMENTS

CN 106662382 A 5/2017
CN 108779943 A 11/2018
(Continued)

OTHER PUBLICATIONS

CN-208398432-U translation.*
(Continued)

*Primary Examiner* — Elizabeth J Martin
(74) *Attorney, Agent, or Firm* — Birch, Stewart, Kolasch & Birch, LLP

(57) ABSTRACT

A liquid refrigerant distributor is used for a falling liquid film evaporator. The liquid refrigerant distributor includes a gas-liquid two-phase pipe through which a gas-liquid two-phase refrigerant flows, and a first refrigerant tub including a liquid reservoir section into which the gas-liquid two-phase refrigerant flows from the gas-liquid two-phase pipe. The first refrigerant tub further includes a droplet collector configured to collect droplets contained in a gas refrigerant separated by the liquid reservoir section.

22 Claims, 10 Drawing Sheets

(51) Int. Cl.
*F28D 21/00* (2006.01)
*F28F 9/22* (2006.01)

(56) References Cited

U.S. PATENT DOCUMENTS

| | | | | |
|---|---|---|---|---|
| 2015/0013950 | A1* | 1/2015 | Numata | F28F 9/22 165/157 |
| 2017/0138652 | A1 | 5/2017 | Hattori et al. | |
| 2017/0254573 | A1* | 9/2017 | Numata | F25B 43/00 |
| 2019/0063801 | A1 | 2/2019 | Miyoshi et al. | |

FOREIGN PATENT DOCUMENTS

| | | | | |
|---|---|---|---|---|
| CN | 208398432 | U * | 1/2019 | F25B 39/02 |
| EP | 2841864 | A1 | 3/2015 | |
| JP | 58-183471 | U | 12/1983 | |
| JP | 6-241615 | A | 9/1994 | |
| JP | 2008-116084 | A | 5/2008 | |
| JP | 2014-20753 | A | 2/2014 | |
| JP | 2015-203506 | A | 11/2015 | |
| WO | WO 2013/162759 | A1 | 10/2013 | |

OTHER PUBLICATIONS

International Search Report (PCT/ISA/210) issued in PCT/JP2020/036170, dated Nov. 24, 2020.

Written Opinion of the International Searching Authority (PCT/ISA/237) issued in PCT/JP2020/036170, dated Nov. 24, 2020.

English translation of International Preliminary Report on Patentability and Written Opinion of the International Searching Authority for International Application No. PCT/JP2020/036170, dated Apr. 7, 2022.

Extended European Search Report for European Application No. 20868081.9, dated Aug. 23, 2022.

* cited by examiner

LIQUID REFRIGERANT SPRAYER AND FALLING LIQUID FILM TYPE EVAPORATOR

CROSS REFERENCE TO RELATED APPLICATIONS

This application is a Continuation of PCT International Application No. PCT/JP2020/036170, filed on Sep. 25, 2020, which claims priority under 35 U.S.C. 119 (a) to Patent Application No. 2019-175100, filed in Japan on Sep. 26, 2019, all of which are hereby expressly incorporated by reference into the present application.

TECHNICAL FIELD

The present disclosure relates to a liquid refrigerant distributor and a falling liquid film evaporator.

BACKGROUND ART

A falling liquid film evaporator has been used in a refrigeration apparatus, such as a turbo refrigerator. A falling liquid film evaporator includes a liquid refrigerant distributor between a group of heat transfer tubes inside a tank and a vapor outlet pipe extending outward from an upper portion of the tank. This liquid refrigerant distributor allows a liquid refrigerant to fall to the heat transfer tube group. The liquid refrigerant that has fallen is evaporated by the heat transfer tube group to provide heat exchange. A gas refrigerant resulting from the evaporation by the heat transfer tube group flows out of the tank through the vapor outlet pipe, and is sent to a compressor.

A known liquid refrigerant distributor disclosed in Patent Document 1 mainly includes a gas-liquid two-phase pipe and three-stacked trays. The distributor allows a gas-liquid two-phase refrigerant (liquid-gas) to be horizontally blown from the gas-liquid two-phase pipe to a first one of the trays, where the blown liquid-gas is separated into gas and liquid phases to some extent. The distributor then allows the resultant liquid-gas to fall to a second one of the trays, where the liquid-gas is completely separated into gas and liquid phases. Thereafter, the distributor allows only the liquid refrigerant to fall to a third one of the trays, from which the liquid refrigerant is distributed to the heat transfer tube group.

CITATION LIST

Patent Documents

PATENT DOCUMENT 1: U.S. Pat. No. 10,132,537 B1

SUMMARY

A first aspect of the present disclosure is directed to a liquid refrigerant distributor (30) for use in a falling liquid film evaporator (1). The liquid refrigerant distributor (30) includes: a gas-liquid two-phase pipe (34) through which a gas-liquid two-phase refrigerant flows; and a first refrigerant tub (31) including a liquid reservoir section (32, 33) into which the gas-liquid two-phase refrigerant flows from the gas-liquid two-phase pipe (34). The first refrigerant tub (31) further includes a droplet collector (36) configured to collect droplets contained in a gas refrigerant separated by the liquid reservoir section (32, 33).

DESCRIPTION OF EMBODIMENTS

An embodiment of the present disclosure will be described below with reference to the drawings. The following embodiment is merely a preferred example in nature, and is not intended to limit the scope, applications, or use of the invention.

Embodiment

<Configuration of Falling Liquid Film Evaporator>

Figure 1:
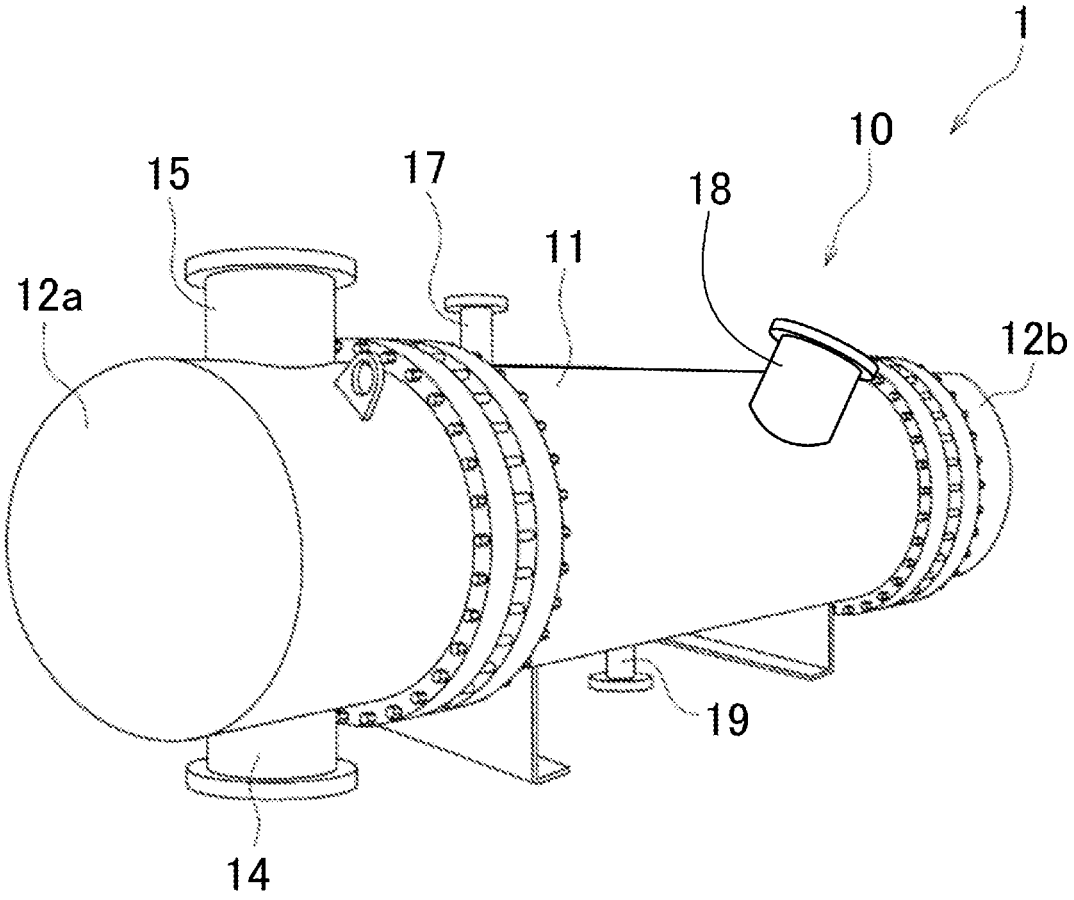
FIG. 1 shows the external appearance of a falling liquid film evaporator according to an embodiment.
Figure 2:
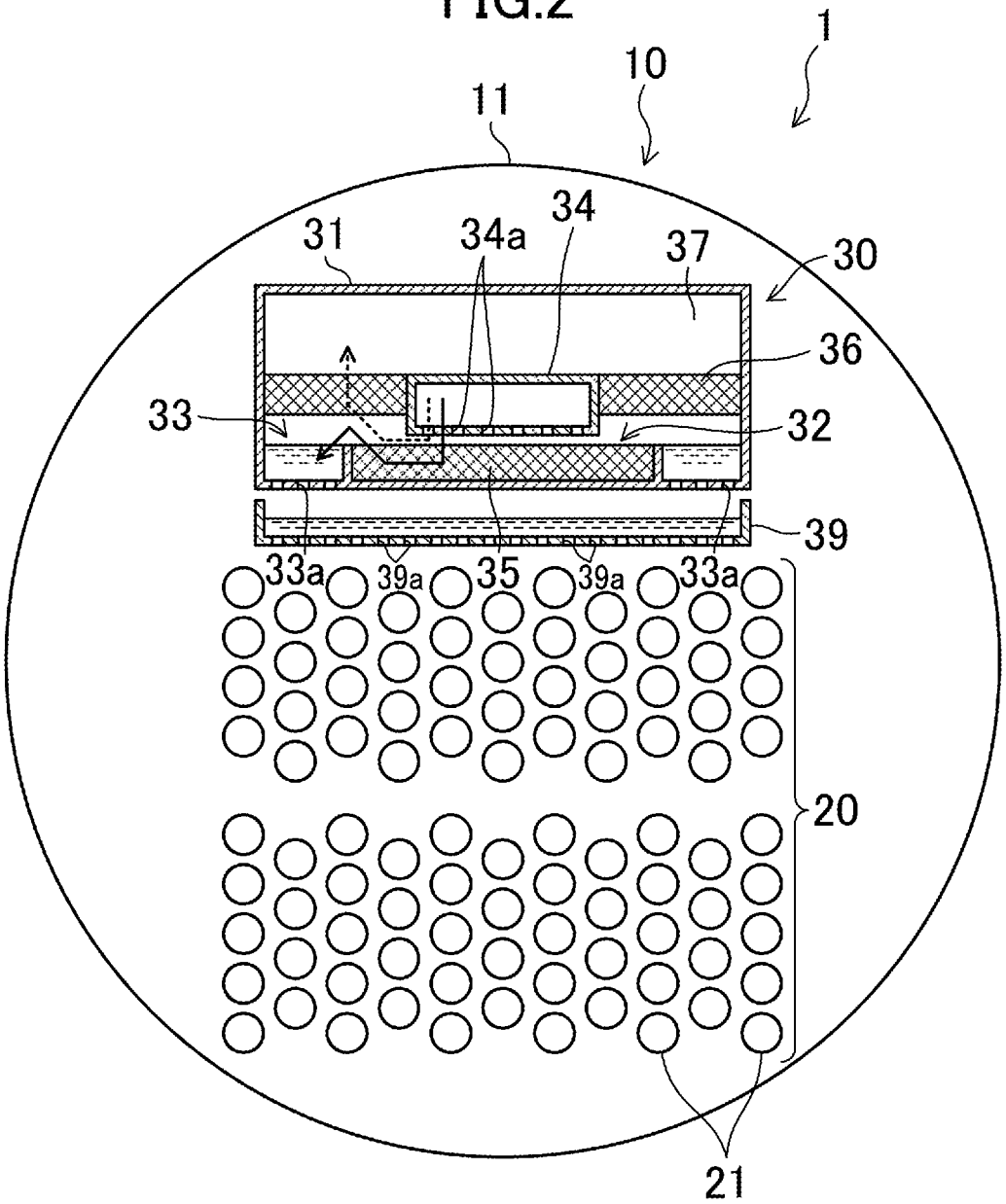
FIG. 2 is a cross-sectional view of the falling liquid film evaporator shown in FIG. 1 as viewed in a tank longitudinal direction.

FIG. 1 shows the external appearance of a falling liquid film evaporator (1) according to this embodiment. FIG. 2 is a cross-sectional view of the falling liquid film evaporator (1) shown in FIG. 1 as viewed in the longitudinal direction of a tank.

The falling liquid film evaporator (1) is used as an evaporator for a refrigeration apparatus, such as a turbo refrigerator. The refrigeration apparatus includes, in addition to the falling liquid film evaporator (1), a compressor, a radiator, an expansion mechanism, and other components (not shown), which all form a vapor compression refrigerant circuit. In the vapor compression refrigerant circuit, a gas refrigerant discharged from the compressor dissipates heat in the radiator, and the refrigerant that has dissipated heat in the radiator is decompressed by the expansion mechanism to enter a gas-liquid two-phase state. The refrigerant in the gas-liquid two-phase state flows into the falling liquid film evaporator (1), and evaporates by exchanging heat with a heating medium, such as water or brine, thereby forming a gas refrigerant. The gas refrigerant flows out of the falling liquid film evaporator (1). The gas refrigerant that has flowed out of the falling liquid film evaporator (1) is again sucked into the compressor. Meanwhile, the liquid refrigerant that has been unable to evaporate by exchanging heat with the heating medium, such as water or brine, flows through a liquid refrigerant return pipe and other members (not shown), and joins the refrigerant in the gas-liquid two-phase state that is about to flow into the falling liquid film evaporator (1). The resultant refrigerant again flows into the falling liquid film evaporator (1).

As illustrated in FIGS. 1 and 2, the falling liquid film evaporator (1) mainly includes a tank (10), a heat transfer tube group (20), and a liquid refrigerant distributor (30). In this embodiment, the falling liquid film evaporator (1) may be a horizontal shell-and-tube heat exchanger, for example. The terms indicating directions, such as "upper," "lower," "left," "right," and "horizontal," as used in the following description refer to the directions observed when the falling liquid film evaporator (1) in use illustrated in FIG. 1 is installed.

The tank (10) mainly includes a shell (11) and heads (12*a*) and (12*b*). In this embodiment, the shell (11) may be a horizontal cylindrical member having two open longitudinal ends. The heads (12*a*) and (12*b*) may be bowl-shaped members that respectively close the two open longitudinal ends of the shell (11).

The head (12*a*) is provided with a heating medium inlet pipe (14) and a heating medium outlet pipe (15). The heating medium inlet pipe (14) is a pipe member used to allow the heating medium to flow into the heat transfer tube group (20) in the tank (10), and is fitted to a lower portion of the head (12*a*), for example. The heating medium outlet pipe (15) is a pipe member used to allow the heating medium to flow out of the tank (10) through the heat transfer tube group (20), and is fitted to an upper portion of the head (12*a*), for example.

The shell (11) is provided with a refrigerant inflow pipe (17), a gas outlet pipe (18), and a liquid outlet pipe (19). The refrigerant inflow pipe (17) is a pipe member used to allow the refrigerant in the gas-liquid two-phase state to flow into a shell space (SS) of the tank (10), and is fitted to a portion of an upper portion of the shell (11) near the longitudinal left end of the shell (11), for example. The end of the refrigerant inflow pipe (17) in the shell (11) serves as a refrigerant inflow port through which the refrigerant flows into the tank (10). The gas outlet pipe (18) is a pipe member used to allow the gas refrigerant formed by evaporating by the heat transfer tube group (20) to flow out of the shell space (SS). The gas outlet pipe (18) extends outward from a portion of the upper portion of the shell (11) inclined with respect to a vertical direction, for example. The liquid outlet pipe (19) is a pipe member used to allow the liquid refrigerant that has been unable to evaporate by the heat transfer tube group (20) to flow out of the shell space (SS), and is fitted to a lower portion of the shell (11), for example.

Out of the refrigerant in the gas-liquid two-phase state to be supplied through the refrigerant inflow pipe (17) into the shell space (SS) of the tank (10), the liquid refrigerant is distributed from above the heat transfer tube group (20) to the heat transfer tube group (20) by the liquid refrigerant distributor (30). The liquid refrigerant distributed to the heat transfer tube group (20) evaporates by exchanging heat with the heating medium flowing through a plurality of heat transfer tubes (21) that form the heat transfer tube group (20), and thus turns into a gas refrigerant. The gas refrigerant formed by evaporating by the heat transfer tube group (20) flows upward toward the gas outlet tube (18), and flows out of the shell space (SS) through the gas outlet pipe (18). The gas refrigerant that has flowed out of the shell space (SS) is again sucked into the compressor (not shown). Meanwhile, the liquid refrigerant that has been unable to evaporate by the heat transfer tube group (20) flows out of the shell space (SS) through the liquid outlet pipe (19) fitted to the lower portion of the shell (11). The liquid refrigerant that has flowed out of the shell space (SS) flows through a liquid refrigerant return pipe and other members (not shown), and joins the refrigerant in the gas-liquid two-phase state that is about to flow into the shell space (SS). The resultant refrigerant again flows through the refrigerant inflow pipe (17) into the shell space (SS).

The heat transfer tube group (20) includes the heat transfer tubes (21) extending along the longitudinal direction of the tank (10). When viewed in the longitudinal direction of the tank (10), the heat transfer tube group (20) is disposed, for example, in substantially a horizontally central region of the shell space (SS) closer to the bottom side of the shell space (SS) in the top-to-bottom direction. When viewed in the longitudinal direction of the tank (10), the heat transfer tubes (21) are staggered in multiple columns and rows, such as in nine columns and eleven rows.

The number and arrangement of the heat transfer tubes (21) forming the heat transfer tube group (20) are merely examples, and may be selected from various numbers and arrangements. If the falling liquid film evaporator (1) includes a tank including a shell that has its one longitudinal end provided with a head, U-shaped heat transfer tubes, for example, may be used.

<Configuration of Liquid Refrigerant Distributor>

Figure 3:
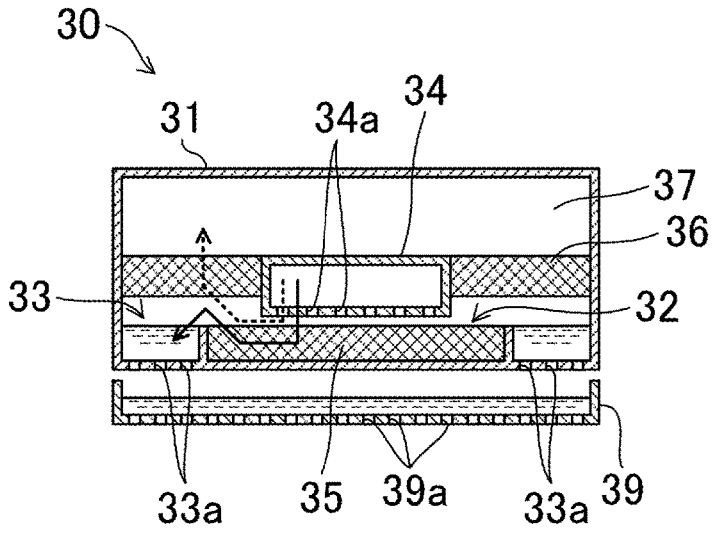
FIG. 3 is a cross-sectional view of a liquid refrigerant distributor according to the embodiment as viewed in the tank longitudinal direction.
Figure 4:
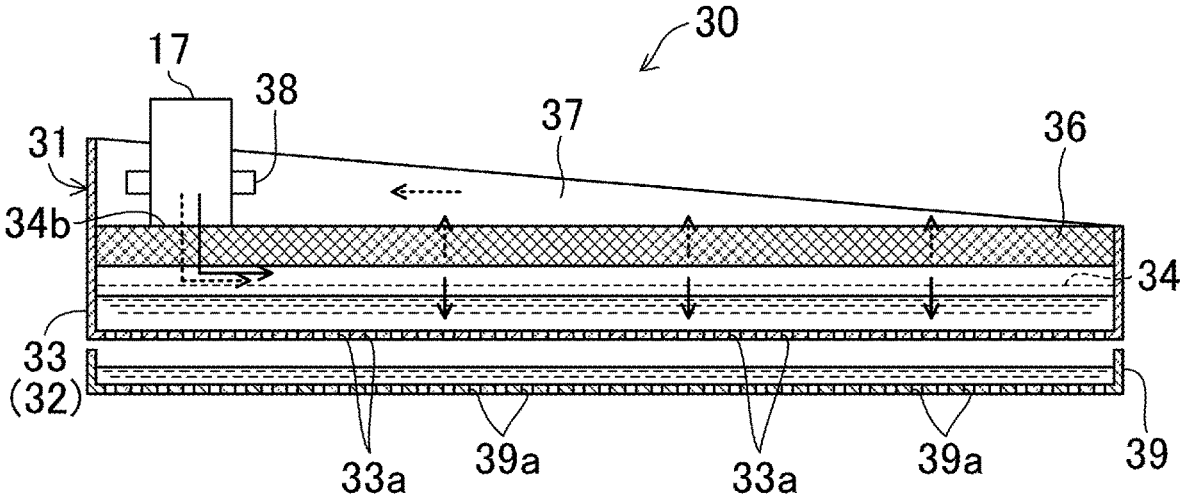
FIG. 4 is a cross-sectional view of the liquid refrigerant distributor according to the embodiment as viewed in a horizontal direction orthogonal to the tank longitudinal direction.

FIG. 3 is a cross-sectional view of the liquid refrigerant distributor (30) as viewed in the tank longitudinal direction. FIG. 4 is a cross-sectional view of the liquid refrigerant distributor (30) as viewed in a horizontal direction orthogonal to the tank longitudinal direction (hereinafter referred to as the "tank lateral direction"). The liquid refrigerant distributor (30) illustrated in FIGS. 3 and 4 is identical to that used for the falling liquid film evaporator (1) illustrated in FIGS. 1 and 2, and is disposed in a portion of the shell space (SS) of the tank (10) between the heat transfer tube group (20) and the gas outlet pipe (18) in the top-to-bottom direction. In FIGS. 3 and 4, the solid arrows indicate the flow of the liquid refrigerant, and the dotted arrows indicate the flow of the gas refrigerant.

As illustrated in FIGS. 3 and 4, the liquid refrigerant distributor (30) mainly includes a first refrigerant tub (31), a gas-liquid two-phase pipe (34), and a second refrigerant tub (39). The first and second refrigerant tubs (31) and (39) and the gas-liquid two-phase pipe (34) each extend along the tank longitudinal direction.

The first refrigerant tub (31) has a liquid reservoir section (32, 33) into which the gas-liquid two-phase refrigerant flows through the two-phase gas-liquid pipe (34), such as primary and secondary liquid reservoirs (32) and (33) adjacent to each other in the horizontal direction (tank lateral direction). The primary liquid reservoir (32) is disposed at a central portion of the first refrigerant tub (31) in the tank lateral direction. The secondary liquid reservoirs (33) are disposed on both sides of the primary liquid reservoir (32) in the tank lateral direction. The gas-liquid two-phase pipe (34) is disposed above the primary liquid reservoir (32). Both lateral ends of the gas-liquid two-phase pipe (34) in the tank lateral direction are located inside both lateral ends of the primary liquid reservoir (32).

The first refrigerant tub (31) may have sidewall portions and a ceiling portion that cover the primary and secondary liquid reservoirs (32) and (33). Alternatively, a cover having sidewall portions and a ceiling portion that cover the primary and secondary liquid reservoirs (32) and (33) may be formed to be combinable with the first refrigerant tub (31).

The gas-liquid two-phase refrigerant is released downward through the two-phase gas-liquid pipe (34) to the primary liquid reservoir (32). The gas-liquid two-phase refrigerant that has flowed into the primary liquid reservoir (32) is separated into a gas refrigerant and a liquid refrigerant in the primary liquid reservoir (32). The liquid refrigerant that has overflowed the primary liquid reservoir (32) flows into the secondary liquid reservoirs (33).

The primary liquid reservoir (32) may include a separation accelerator (35) configured to accelerate gas-liquid separation of the gas-liquid two-phase refrigerant. The structure of the separation accelerator (35) may be any structure that can accelerate gas-liquid separation of the gas-liquid two-phase refrigerant, but may be, for example, a multilayer mesh structure, such as a mist eliminator. In this embodiment, the separation accelerator (35) is disposed in the entirety of the primary liquid reservoir (32) to be adjacent to a lower portion of the gas-liquid two-phase pipe (34), for example.

The gas-liquid two-phase pipe (34) is a pipe member for guiding the gas-liquid two-phase refrigerant supplied through the refrigerant inflow pipe (17) into the shell space (SS) to the first refrigerant tub (31) to spread the refrigerant in the tank longitudinal direction. The bottom of the gas-liquid two-phase pipe (34) has a plurality of holes (34*a*) through which the gas-liquid two-phase refrigerant is released downward to the primary liquid reservoir (32). The refrigerant inflow pipe (17) is connected to an introduction port (34*b*) formed through one end portion (a left end portion in FIG. 4) of the gas-liquid two-phase pipe (34). The gas-liquid two phase pipe (34) may have, for example, a rectangular cross section as viewed in the tank longitudinal direction.

The second refrigerant tub (39) is disposed below the first refrigerant tub (31). The liquid refrigerant that has flowed into the secondary liquid reservoirs (33) flows into the second refrigerant tub (39) after passing through a plurality of communication holes (33*a*) formed through the bottoms of the secondary liquid reservoirs (33). The liquid level of the liquid refrigerant is equalized in the second refrigerant tub (39). The liquid refrigerant that has flowed into the second refrigerant tub (39) is distributed to the heat transfer tube group (20) after passing through a plurality of communication holes (39*a*) formed through the bottom of the second refrigerant tub (39).

In this embodiment, the first refrigerant tub (31) may have a gas passage portion (37) through which the gas refrigerant separated by the primary liquid reservoir (32) is passed, and a gas discharge port (38) through which the gas refrigerant that has passed through the gas passage portion (37) is discharged from the first refrigerant tub (31). The gas passage portion (37) is provided, for example, at an upper portion of the first refrigerant tub (31) along the tank longitudinal direction. The gas discharge port (38) is provided, for example, at an upper portion of a sidewall (an upper portion of one or each of sidewalls in the tank lateral direction) of the first refrigerant tub (31) near the refrigerant inflow pipe (17). The cross-sectional area of the gas passage portion (37) as viewed in the tank longitudinal direction may increase toward the gas discharge port (38). In this case, the cross-sectional area of a region of the gas passage portion (37) corresponding to the gas outlet pipe (18) (see FIG. 1) of the falling liquid film evaporator (1) as viewed in the tank longitudinal direction may be relatively small.

The first refrigerant tub (31) may further include a droplet collector (36) configured to collect droplets contained in the gas refrigerant separated by the primary liquid reservoir (32).

The structure of the droplet collector (36) may be any structure that can collect droplets contained in the gas refrigerant, but may be, for example, a multilayer mesh structure, such as a mist eliminator. The position at which the droplet collector (36) is arranged may be any position above the primary and secondary liquid reservoirs (32) and (33), i.e., the liquid reservoir section (32, 33). The droplet collector (36) may be adjacent to, for example, both sides of the gas-liquid two-phase pipe (34) in the tank lateral direction or an upper portion of the gas-liquid two-phase pipe (34). In this case, the gas passage portion (37) may be provided above the droplet collector (36) and the gas-liquid two-phase pipe (34).

Providing the droplet collector (36) above the liquid reservoir section (32, 33) allows the droplets collected by the droplet collector (36) to condense to drop. Thus, the droplets can be recovered in the liquid reservoir section (32, 33). If the first refrigerant tub (31) has the sidewall portions surrounding the liquid reservoir section (32, 33) (or the cover having the sidewall portions), the droplets collected by the droplet collector (36) can also be dropped along the sidewall portions or the cover to the liquid reservoir section (32, 33).

<Bottom Structure of Gas-Liquid Two-Phase Pipe>

In this embodiment, the bottom of the gas-liquid two-phase pipe (34) may have a perforated metal structure with a plurality of holes (34*a*), and the area proportion of the holes (34*a*) in the perforated metal structure (the proportion of the area of the holes (34*a*) per unit area) may increase with increasing distance from the introduction port (34*b*) of the two-phase gas-liquid pipe (34) for the gas-liquid two-phase refrigerant.

Figure 5:
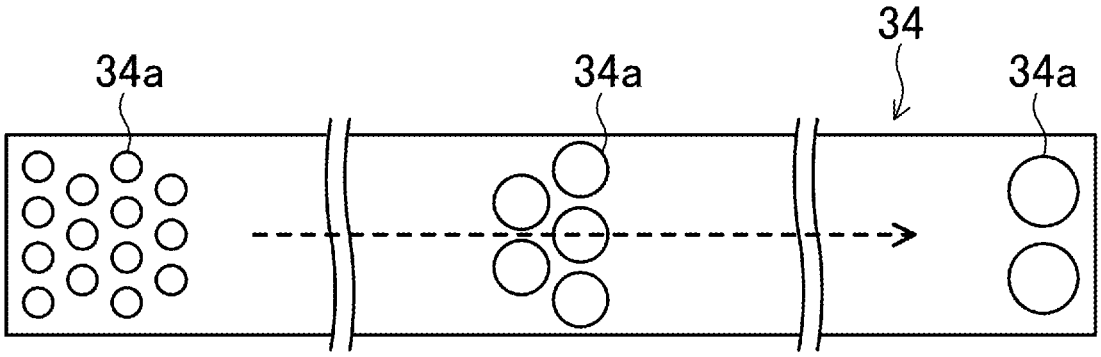
FIG. 5 illustrates an exemplary planar configuration of the bottom of a gas-liquid two-phase pipe of the liquid refrigerant distributor illustrated in FIG. 4.
Figure 6:
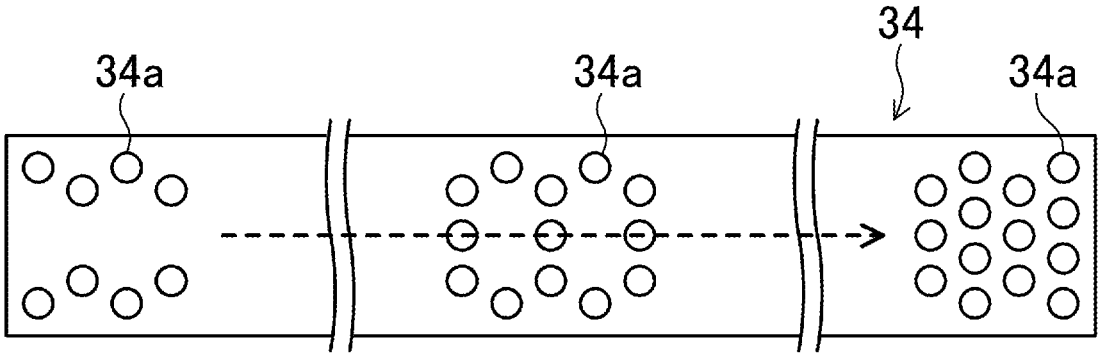
FIG. 6 illustrates another exemplary planar configuration of the bottom of the gas-liquid two-phase pipe of the liquid refrigerant distributor illustrated in FIG. 4.
Figure 7:
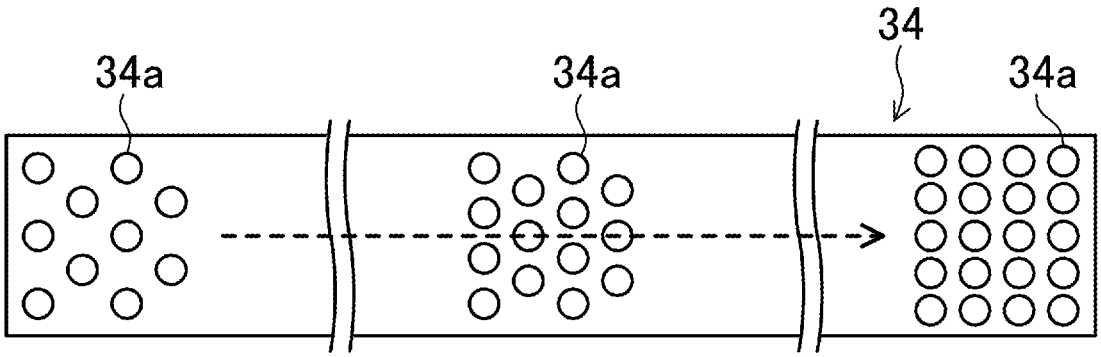
FIG. 7 illustrates still another exemplary planar configuration of the bottom of the gas-liquid two-phase pipe of the liquid refrigerant distributor illustrated in FIG. 4.

FIGS. 5 to 7 each illustrate an exemplary planar configuration of the bottom of the gas-liquid two-phase pipe (34) of the liquid refrigerant distributor (30) illustrated in FIG. 4. FIGS. 5 to 7 each show a case where the introduction port (34*b*) is located in the left lateral end portion of the gas-liquid two-phase pipe (34). The (dotted) arrow shown in each of FIGS. 5 to 7 indicates the direction in which the gas-liquid two-phase refrigerant flows.

For example, as illustrated in FIG. 5, the holes (34*a*) may have their sizes increased with increasing distance from the introduction port (34*b*). Alternatively, for example, as illustrated in FIGS. 6 and 7, the holes (34*a*) may have substantially the same size, and the density of the holes (34*a*) arranged may be increased with increasing distance from the introduction port (34*b*).

Advantages of Embodiment

The first refrigerant tub (31) of the liquid refrigerant distributor (30) according to this embodiment described above may further include the droplet collector (36) configured to collect droplets contained in the gas refrigerant separated by the liquid reservoir section (32, 33). Thus, the droplet collector (36) can substantially prevent a liquid refrigerant from being carried away to the outside of the first refrigerant tub (31) together with the gas refrigerant. This can reduce the number of refrigerant tubs (trays) stacked, thus reducing the size of the liquid refrigerant distributor (30). Thus, even if the existing size of the shell space (SS) of the falling liquid film evaporator (1) remains unchanged, the position at which the liquid refrigerant distributor (30) is arranged can be raised in the shell space (SS) to enlarge the space where the heat transfer tube group (20) is arranged. This can reduce the carryover phenomenon. Reducing the number of the trays stacked can trigger a reduction in the amount of the refrigerant contained in each tray.

When, in the liquid refrigerant distributor (30) of this embodiment, the gas-liquid two-phase pipe (34) releases a gas-liquid two-phase refrigerant downward to the liquid reservoir section (32, 33), the droplet collector (36) can prevent liquid splashes.

In the liquid refrigerant distributor (30) of this embodiment, the bottom of the gas-liquid two-phase pipe (34) may have a perforated metal structure with a plurality of holes (34*a*), and the area proportion of the holes (34*a*) in the perforated metal structure may increase with increasing distance from the introduction port (34*b*) of the gas-liquid two-phase pipe (34) for the gas-liquid two-phase refrigerant. This allows the resistance at distribution of the two-phase gas-liquid refrigerant to the liquid reservoir section (32, 33) to decrease with increasing distance from the introduction port (34*b*) toward the far side of the two-phase gas-liquid pipe (34). This can reduce uneven flow in the longitudinal direction of the gas-liquid two-phase pipe (34) to improve the performance of distributing the liquid refrigerant.

In the liquid refrigerant distributor (30) of this embodiment, the liquid reservoir section (32, 33) may include the primary liquid reservoir (32) into which the gas-liquid two-phase refrigerant flows, and the secondary liquid reservoirs (33) into which the liquid refrigerant separated from the gas refrigerant by the primary liquid reservoir (32) flows, and the secondary liquid reservoirs (33) may be respectively disposed on both sides of the primary liquid reservoir (32). Thus, the first refrigerant tub (31) including the primary and secondary liquid reservoirs (32) and (33) arranged side by side enables substantial gas-liquid separation, and the primary liquid reservoir (32) can absorb the pressure at which the gas-liquid two-phase refrigerant is ejected. This can reduce the speed at which the liquid refrigerant flows into the secondary liquid reservoir (33). In this case, if the secondary liquid reservoir (33) is configured to gather the liquid refrigerant that has overflowed the primary liquid reservoir (32), substantially only the liquid refrigerant can be gathered in the secondary liquid reservoir (33).

The liquid refrigerant distributor (30) of this embodiment may further include the second refrigerant tub (39) disposed below the first refrigerant tub (31). The liquid reservoir section (32, 33) may have the communication holes (33*a*) through each of which the liquid refrigerant falls to the second refrigerant tub (39). The liquid refrigerant that has fallen to the second refrigerant tub (39) may be distributed to the heat transfer tube group (20) of the falling liquid film evaporator (1). This allows two-stacked refrigerant tubs (trays) to form the liquid refrigerant distributor (30).

If, in the liquid refrigerant distributor (30) of this embodiment, the first refrigerant tub (31) has the gas passage portion (37) through which the gas refrigerant separated by the liquid reservoir section (32, 33) is passed, and the gas discharge port (38) through which the gas refrigerant that has passed through the gas passage portion (37) is discharged from the first refrigerant tub (31), the gas refrigerant separated by the liquid reservoir section (32, 33) can be discharged from the first refrigerant tub (31).

If the first refrigerant tub (31) has the gas passage portion (37) and the gas discharge port (38), and the cross-sectional area of the gas passage portion (37) (as viewed in the tank longitudinal direction) increases with decreasing distance to the gas discharge port (38), the speed at which the gas refrigerant travels in the first refrigerant tub (31) can be equalized. Thus, the liquid level of the liquid refrigerant gathered in the liquid reservoir section (32, 33) is also equalized. In other words, unlike the known configuration in which the cross-sectional area of the gas passage portion is uniform along the tank longitudinal direction, the traveling speed of the gas refrigerant can be prevented from increasing with decreasing distance to the gas discharge port. This can prevent the resultant pressure difference from causing the liquid level of the liquid refrigerant to rise near the gas discharge port. This can substantially prevent the liquid refrigerant from being carried away from the gas discharge port (38) to the outside of the first refrigerant tub (31) together with the gas refrigerant.

Figure 8:
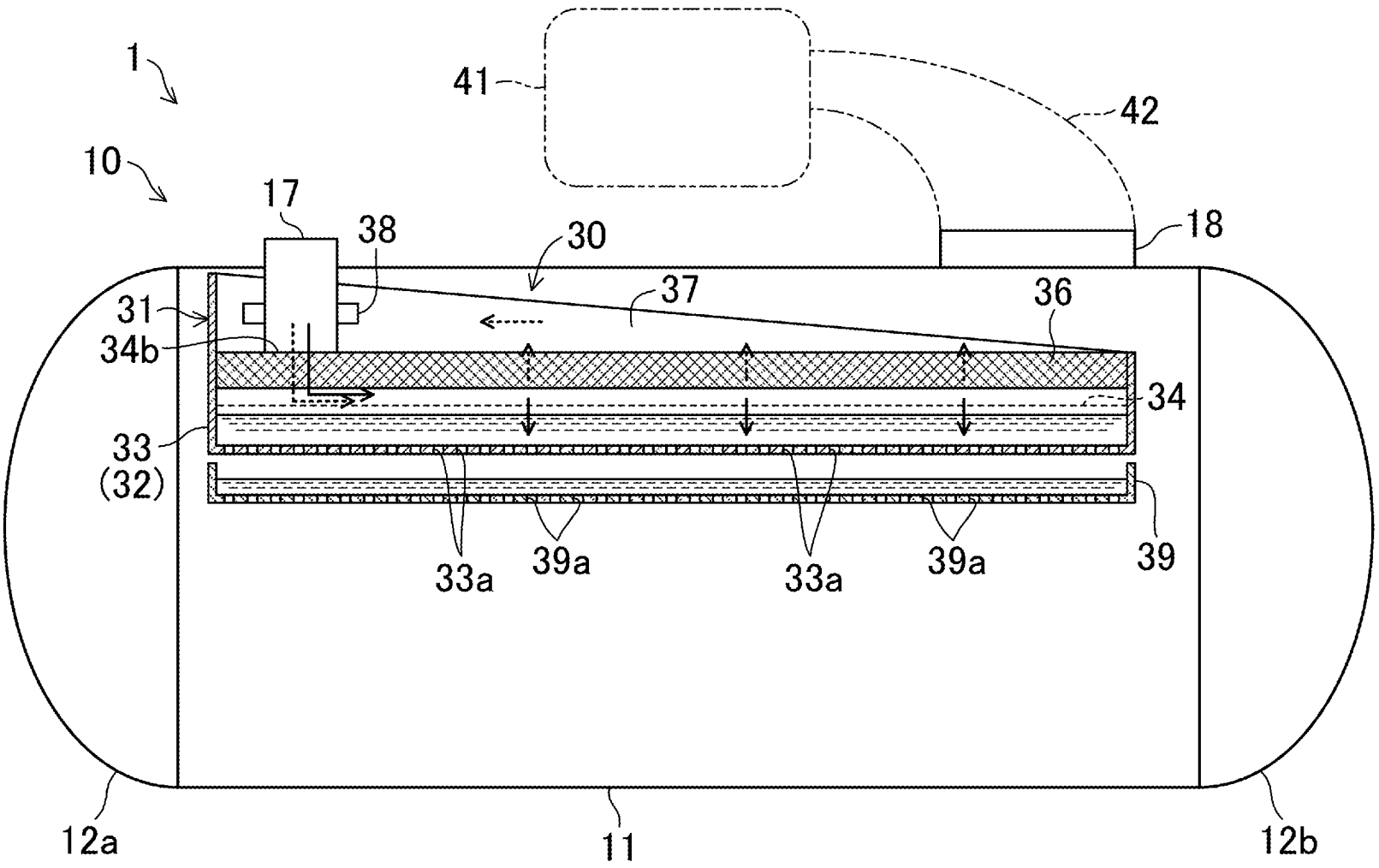
FIG. 8 schematically illustrates the positional relation between the liquid refrigerant distributor illustrated in FIG. 4 and a gas outlet pipe of the falling liquid film evaporator.

If the cross-sectional area of the gas passage portion (37) increases with decreasing distance to the gas discharge port (38), the cross-sectional area of the region of the gas passage portion (37) corresponding to the gas outlet pipe (18) of the falling liquid film evaporator (1) may be relatively small as illustrated in FIG. 8, for example. This allows the cross-sectional area of the gas outlet pipe (18) of the falling liquid film evaporator (1), i.e., the cross-sectional area of the pipe (42) extending toward a compressor (41) to be set to be larger. This can improve the performance of a refrigeration apparatus including the falling liquid film evaporator (1).

FIG. 8 schematically illustrates the positional relation between the liquid refrigerant distributor (30) illustrated in FIG. 4 and the gas outlet pipe (18) of the falling liquid film evaporator (1). In FIG. 8, like reference characters are used to indicate the same components as those of the falling liquid film evaporator (1) and the liquid refrigerant distributor (30) illustrated in FIGS. 1 to 4. FIG. 8 does not illustrate some of the components, such as the heat transfer tube group (20), for the sake of simplicity, and schematically illustrates the shapes of the tank (10) and other components.

In the liquid refrigerant distributor (30) according to this embodiment, the droplet collector (36) being a mist eliminator can efficiently remove droplets contained in the gas refrigerant separated by the liquid reservoir section (32, 33).

In the liquid refrigerant distributor (30) of this embodiment, the droplet collector (36) may be adjacent to each of side portions or an upper portion of the gas-liquid two-phase pipe (34). This enables delivery of the gas refrigerant from which the droplets have been removed.

If the liquid reservoir section (32, 33) includes the primary and secondary liquid reservoirs (32) and (33), and the primary liquid reservoir (32) includes the separation accelerator (35) configured to accelerate gas-liquid separation of the gas-liquid two-phase refrigerant, the gas-liquid separation in the primary liquid reservoir (32) can be further accelerated. In addition, ruffling of the liquid surface of the liquid refrigerant in the primary liquid reservoir (32) can be reduced, thereby reducing the amount of the droplets scattered. Setting the liquid level of the liquid refrigerant in the primary liquid reservoir (32) at about 40 mm or more, for example, in view of an uneven flow in the tank longitudinal direction may allow the liquid refrigerant to be uniformly spread from the primary liquid reservoir (32) to the secondary liquid reservoir (33).

If the primary liquid reservoir (32) includes the separation accelerator (35), the separation accelerator (35) being a mist eliminator can efficiently separate the gas refrigerant and the liquid refrigerant from each other.

If the primary liquid reservoir (32) includes the separation accelerator (35), the separation accelerator (35) may be disposed in the entirety of the primary liquid reservoir (32) to be adjacent to the lower portion of the gas-liquid two-phase pipe (34). This makes it difficult for the gas-liquid two-phase refrigerant released from the gas-liquid two-phase pipe (34) to be scattered by collision with the separation accelerator (35).

The liquid refrigerant distributor (30) of the falling liquid film evaporator (1) according to this embodiment can have its size reduced. Thus, the position at which the liquid refrigerant distributor (30) is arranged can be raised in the shell of the falling liquid film evaporator (1) with the existing size to enlarge the space where the heat transfer tube group (20) is arranged. This can reduce the carryover phenomenon.

<First Variation>

Figure 9:
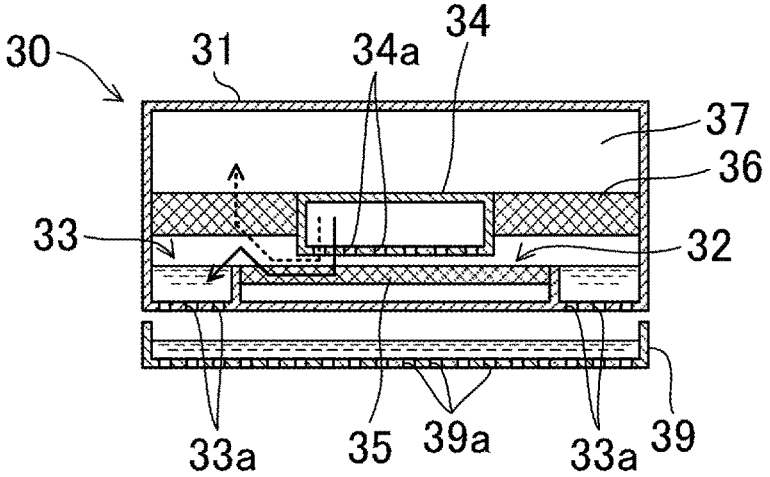
FIG. 9 is a cross-sectional view of a liquid refrigerant distributor according to a first variation as viewed in the tank longitudinal direction.

FIG. 9 is a cross-sectional view of a liquid refrigerant distributor (30) according to a first variation as viewed in the tank longitudinal direction. In FIG. 9, like reference characters are used to indicate the same components as those of the liquid refrigerant distributor (30) of the foregoing embodiment illustrated in FIG. 3.

The difference of the liquid refrigerant distributor (30) of this variation illustrated in FIG. 9 from that of the foregoing embodiment illustrated in FIG. 3 is that a separation accelerator (35) does not fill a primary liquid reservoir (32) but is disposed only in an upper portion of the primary liquid reservoir (32). Also in this variation, just like the foregoing embodiment, the separation accelerator (35) is adjacent to a lower portion of a gas-liquid two-phase pipe (34).

This variation described above can also provide advantages similar to those of the foregoing embodiment. For example, the separation accelerator (35) adjacent to the lower portion of the gas-liquid two-phase pipe (34) makes it difficult for a gas-liquid two-phase refrigerant released from the gas-liquid two-phase pipe (34) to be scattered by collision with the separation accelerator (35).

<Second Variation>

Figure 10:
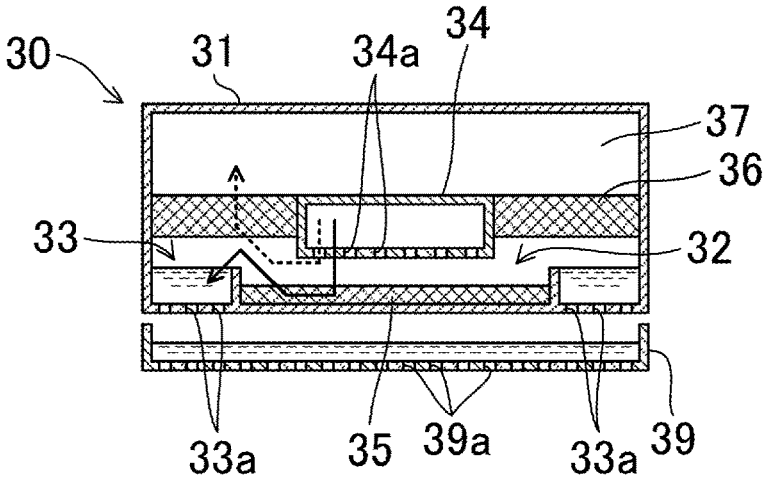
FIG. 10 is a cross-sectional view of a liquid refrigerant distributor according to a second variation as viewed in the tank longitudinal direction.

FIG. 10 is a cross-sectional view of a liquid refrigerant distributor (30) according to a second variation as viewed in the tank longitudinal direction. In FIG. 10, like reference characters are used to indicate the same components as those of the liquid refrigerant distributor (30) of the foregoing embodiment illustrated in FIG. 3.

The difference of the liquid refrigerant distributor (30) of this variation illustrated in FIG. 10 from that of the foregoing embodiment illustrated in FIG. 3 is that a separation accelerator (35) does not fill a primary liquid reservoir (32) but is disposed only in a lower portion of the primary liquid reservoir (32). That is to say, in this variation, unlike the foregoing embodiment, the separation accelerator (35) is not adjacent to a lower portion of a gas-liquid two-phase pipe (34).

This variation described above can also provide advantages similar to those of the foregoing embodiment. In addition, the separation accelerator (35) disposed only in the lower portion of the primary liquid reservoir (32) makes it difficult to interfere with the release of a gas-liquid two-phase refrigerant from the gas-liquid two-phase pipe (34).

<Third Variation>

Figure 11:
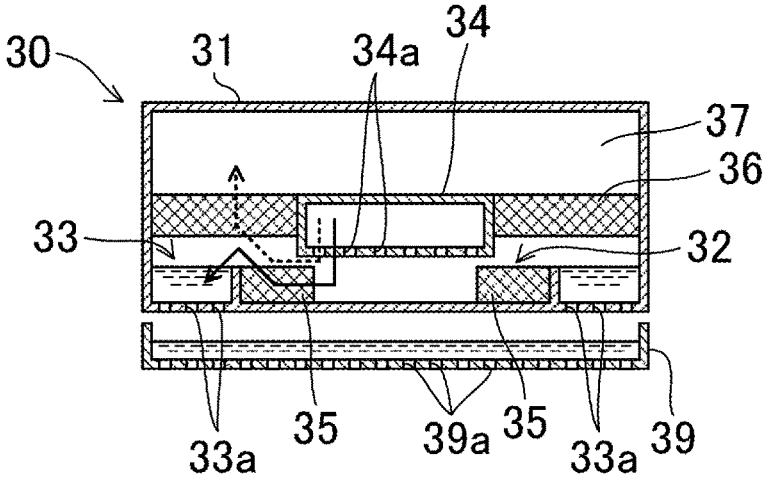
FIG. 11 is a cross-sectional view of a liquid refrigerant distributor according to a third variation as viewed in the tank longitudinal direction.

FIG. 11 is a cross-sectional view of a liquid refrigerant distributor (30) according to a third variation as viewed in the tank longitudinal direction. In FIG. 11, like reference characters are used to indicate the same components as those of the liquid refrigerant distributor (30) of the foregoing embodiment illustrated in FIG. 3.

The difference of the liquid refrigerant distributor (30) of this variation illustrated in FIG. 11 from that of the foregoing embodiment illustrated in FIG. 3 is that a separation accelerator (35) does not fill a primary liquid reservoir (32), but separation accelerators (35) are respectively arranged only in both side portions (in the tank lateral direction) of the primary liquid reservoir (32). That is to say, in this variation, unlike the foregoing embodiment, at least one portion of each separation accelerator (35) is not adjacent to a lower portion of a gas-liquid two-phase pipe (34).

This variation described above can also provide advantages similar to those of the foregoing embodiment. In addition, the separation accelerators (35) arranged only in both side portions of the primary liquid reservoir (32) make it difficult to interfere with the release of a gas-liquid two-phase refrigerant from the gas-liquid two-phase pipe (34).

<Fourth Variation>

Figure 12:
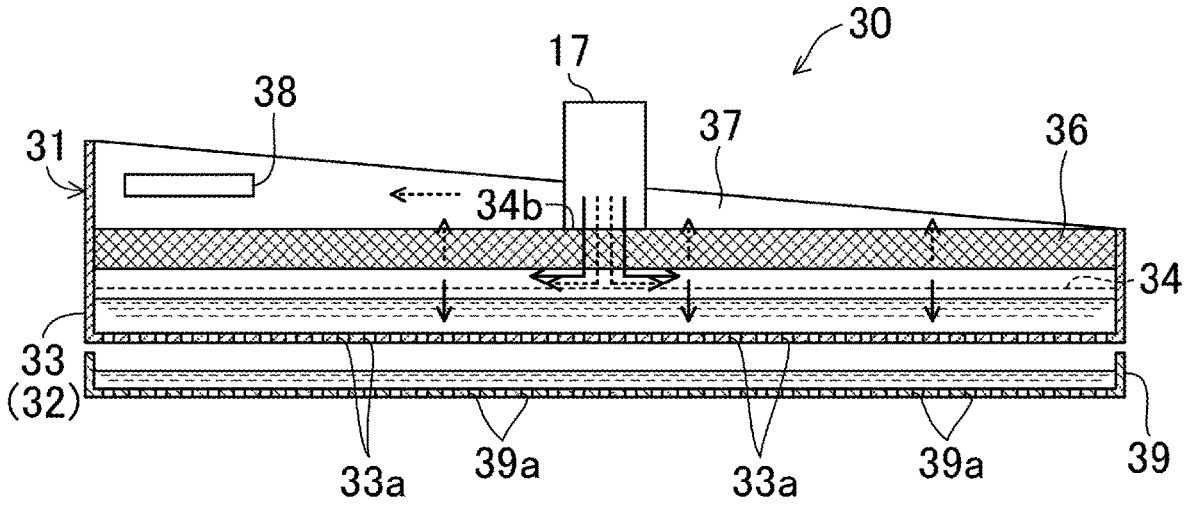
FIG. 12 is a cross-sectional view of a liquid refrigerant distributor according to a fourth variation as viewed in a horizontal direction orthogonal to the tank longitudinal direction.

FIG. 12 is a cross-sectional view of a liquid refrigerant distributor according to a fourth variation as viewed in the tank lateral direction. In FIG. 12, like reference characters are used to indicate the same components as those of the liquid refrigerant distributor (30) of the foregoing embodiment illustrated in FIG. 4.

The difference of the liquid refrigerant distributor (30) of this variation illustrated in FIG. 12 from that of the foregoing embodiment illustrated in FIG. 4 is that a gas-liquid two-phase pipe (34) has a middle portion with an introduction port (34*b*), which is connected to a refrigerant inflow pipe (17). That is to say, in this variation, a gas-liquid two-phase refrigerant supplied through the refrigerant inflow pipe (17) to the introduction port (34*b*) of the middle portion of the gas-liquid two-phase pipe (34) is delivered through the introduction port (34*b*) to both sides of the gas-liquid two-phase pipe (34) in the tank longitudinal direction, and flows through a plurality of holes (34*a*) formed at the bottom of the gas-liquid two-phase pipe (34) into a primary liquid reservoir (32) of a first refrigerant tub (31).

In this variation, the area proportion of the holes (34*a*) (the proportion of the area of the holes (34*a*) per unit area) may increase with increasing distance from the introduction port (34*b*) of the gas-liquid two-phase pipe (34) for the gas-liquid two-phase refrigerant.

Figure 13:
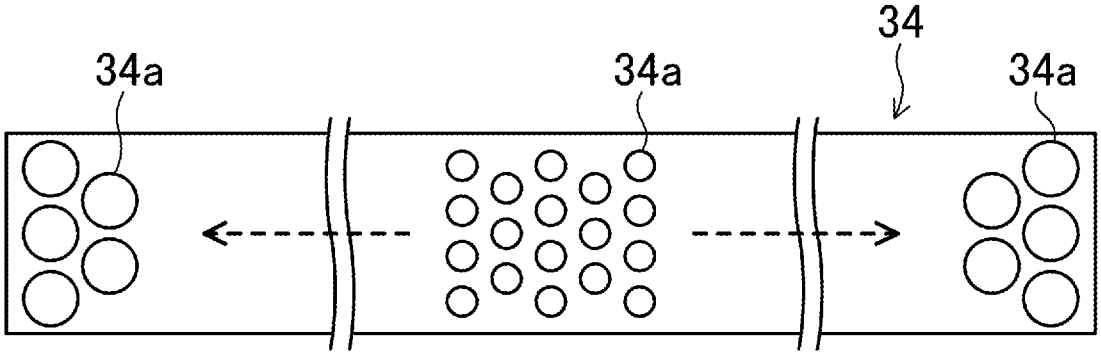
FIG. 13 illustrates an exemplary planar configuration of the bottom of a gas-liquid two-phase pipe of the liquid refrigerant distributor illustrated in FIG. 12.
Figure 14:
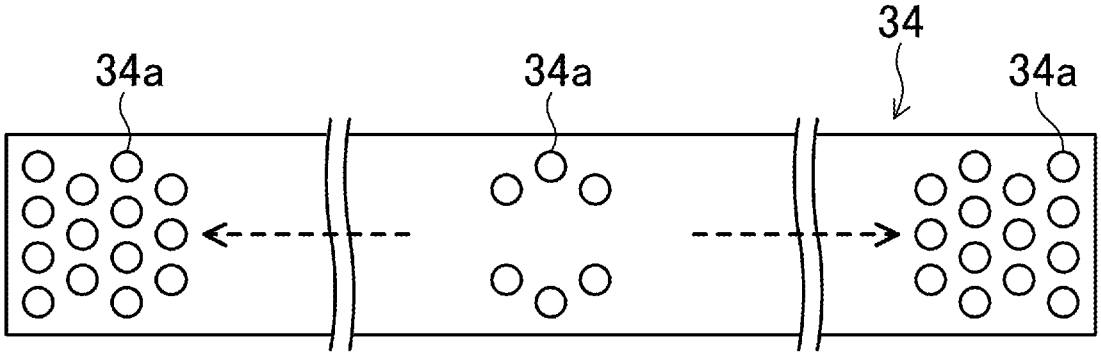
FIG. 14 illustrates another exemplary planar configuration of the bottom of the gas-liquid two-phase pipe of the liquid refrigerant distributor illustrated in FIG. 12.
Figure 15:
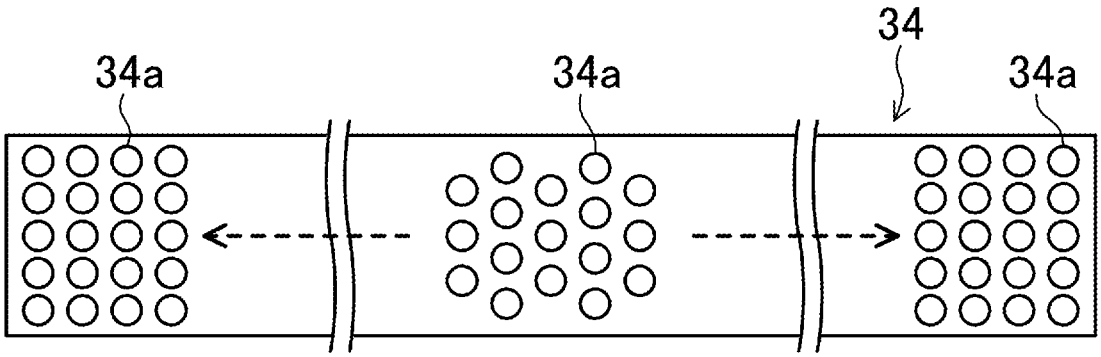
FIG. 15 illustrates still another exemplary planar configuration of the bottom of the gas-liquid two-phase pipe of the liquid refrigerant distributor illustrated in FIG. 12.

FIGS. 13 to 15 each illustrate an exemplary planar configuration of the bottom of the gas-liquid two-phase pipe (34) of the liquid refrigerant distributor (30) illustrated in FIG. 12. FIGS. 13 to 15 each show a case where the introduction port (34*b*) is located at the middle portion of the gas-liquid two-phase pipe (34). The (dotted) arrows shown in each of FIGS. 13 to 15 indicate the directions in which the gas-liquid two-phase refrigerant flows.

For example, as illustrated in FIG. 13, the holes (34*a*) may have their sizes increased with increasing distance from the introduction port (34*b*). Alternatively, for example, as illustrated in FIGS. 14 and 15, the holes (34*a*) may have substantially the same size, and the density of the holes (34*a*) arranged may be increased with increasing distance from the introduction port (34*b*).

This variation described above can also provide advantages similar to those of the foregoing embodiment. For example, the area proportion of the holes (34*a*) formed at the bottom of the gas-liquid two-phase pipe (34) increases with increasing distance from the introduction port (34*b*) of the gas-liquid two-phase pipe (34) for the gas-liquid two-phase refrigerant. This allows the resistance at distribution of the gas-liquid two-phase refrigerant to the primary liquid reservoir (32) to decrease with increasing distance from the introduction port (34*b*) toward the far side of the two-phase gas-liquid pipe (34). This can reduce uneven flow in the longitudinal direction of the gas-liquid two-phase pipe (34) to improve the performance of distributing the liquid refrigerant.

Figure 16:
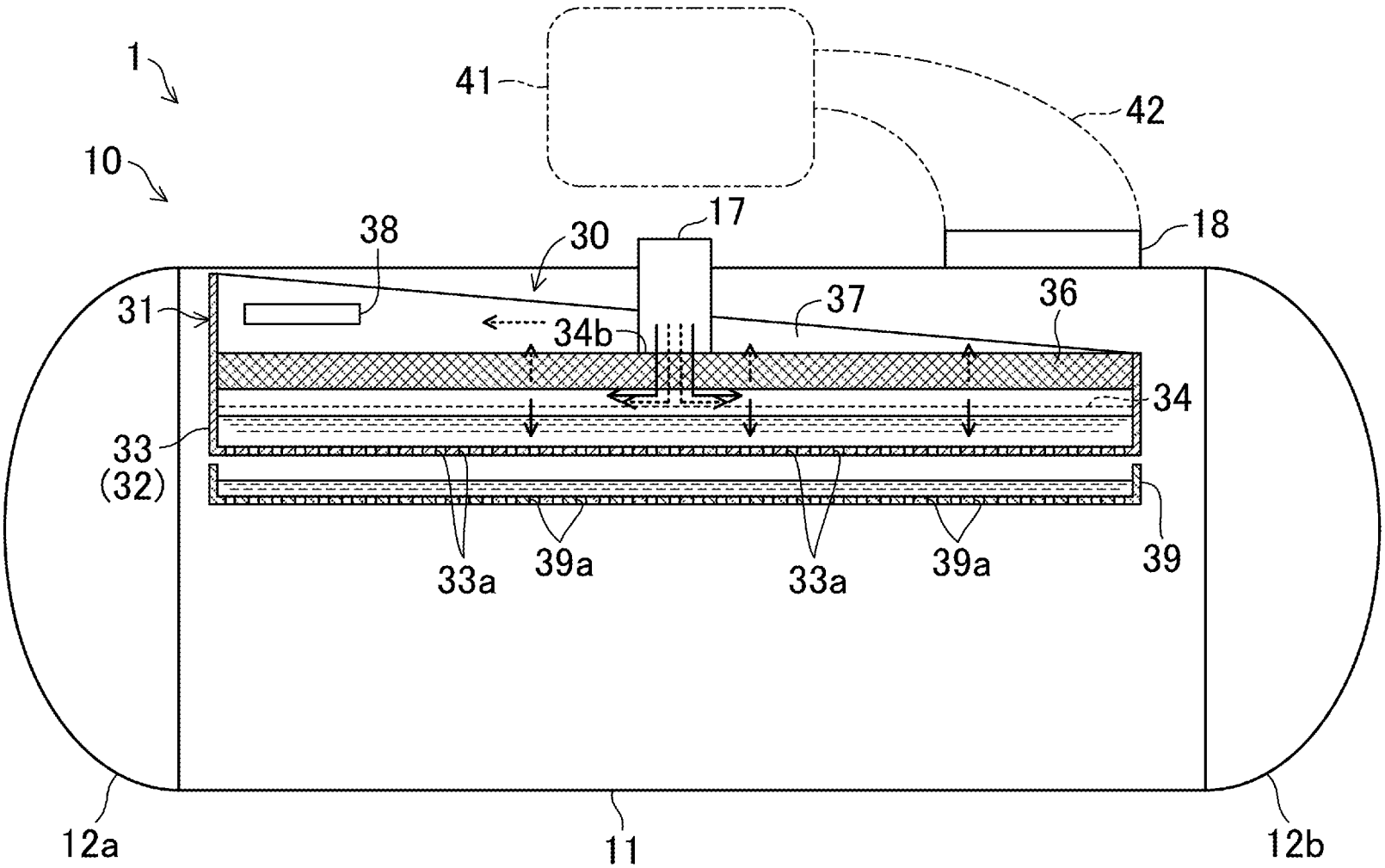
FIG. 16 schematically illustrates the positional relation between the liquid refrigerant distributor illustrated in FIG. 12 and a gas outlet pipe of a falling liquid film evaporator.

In this variation, the cross-sectional area of a region of a gas passage portion (37) corresponding to a gas outlet pipe (18) of the falling liquid film evaporator (1) may be relatively small as illustrated in FIG. 16, for example. This allows the cross-sectional area of the gas outlet pipe (18) of the falling liquid film evaporator (1), i.e., the cross-sectional area of the pipe (42) extending toward a compressor (41) to be set to be larger. This can improve the performance of a refrigeration apparatus including the falling liquid film evaporator (1).

FIG. 16 schematically illustrates the positional relation between the liquid refrigerant distributor (30) illustrated in FIG. 12 and the gas outlet pipe (18) of the falling liquid film evaporator (1). In FIG. 16, like reference characters are used to indicate the same components as those of the falling liquid film evaporator (1) and the liquid refrigerant distributor (30) illustrated in FIGS. 1 to 4 and 12. FIG. 16 does not illustrate some of the components, such as the heat transfer tube group (20), for the sake of simplicity, and schematically illustrates the shapes of the tank (10) and other components.

<Fifth Variation>

Figure 17:
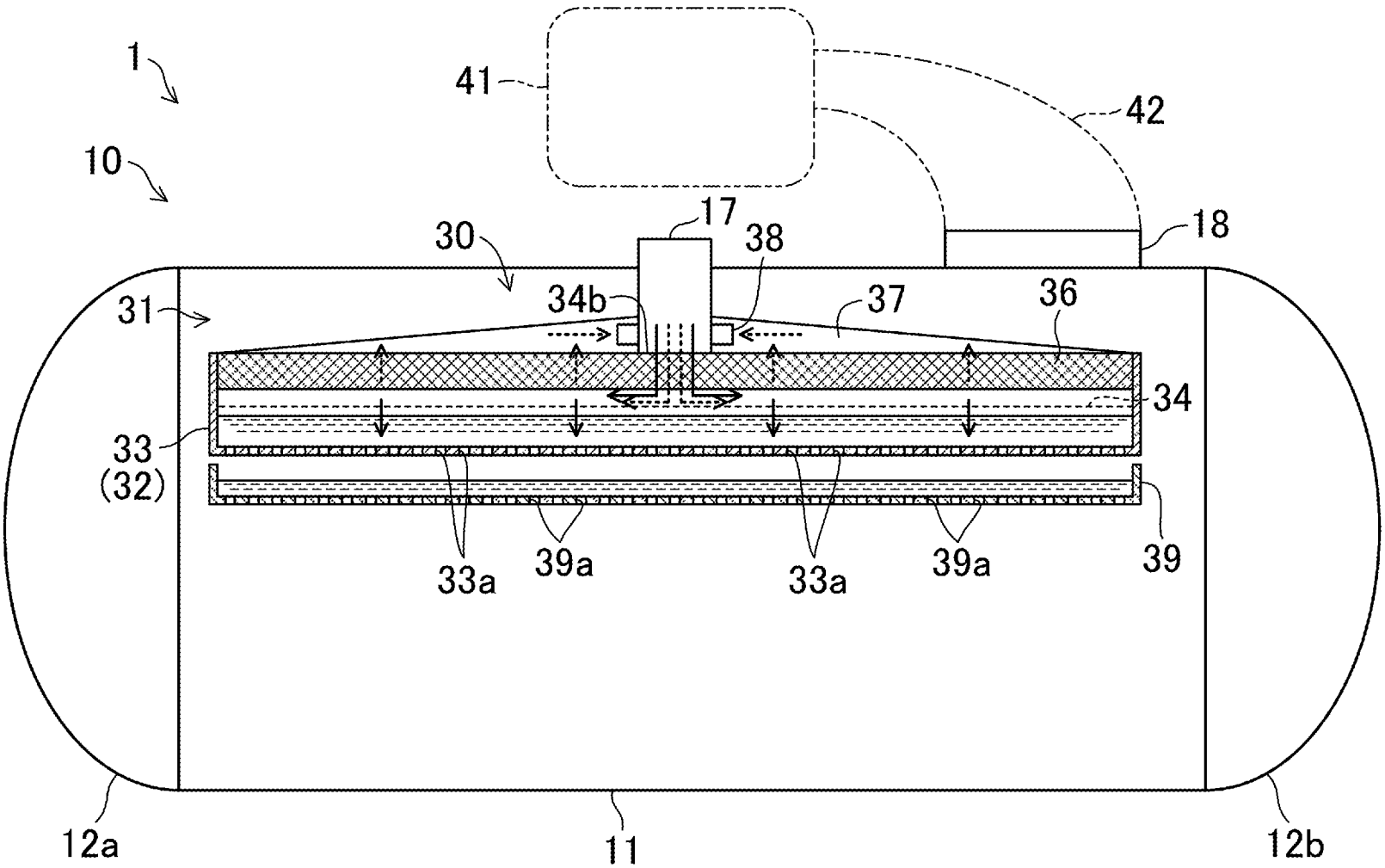
FIG. 17 schematically illustrates the positional relation between a liquid refrigerant distributor according to a fifth variation and a gas outlet pipe of a falling liquid film evaporator.

FIG. 17 schematically illustrates the positional relation between a liquid refrigerant distributor (30) according to a fifth variation and a gas outlet pipe (18) of a falling liquid film evaporator (1). In FIG. 17, like reference characters are used to indicate the same components as those of the foregoing embodiment illustrated in FIGS. 4 and 8. FIG. 17 does not illustrate some of the components, such as the heat transfer tube group (20), for the sake of simplicity, and schematically illustrates the shapes of the tank (10) and other components.

The difference of the liquid refrigerant distributor (30) of this variation illustrated in FIG. 17 from that of the foregoing embodiment illustrated in FIG. 4 is that a gas-liquid two-phase pipe (34) has a middle portion with an introduction port (34*b*), which is connected to a refrigerant inflow pipe (17).

In this variation, a gas discharge port (38) is provided at an upper portion of a sidewall (an upper portion of one or each of sidewalls in the tank lateral direction) of a first refrigerant tub (31) near the refrigerant inflow pipe (17), i.e., near the introduction port (34*b*) of the middle portion of the gas-liquid two-phase pipe (34). The cross-sectional area of a gas passage portion (37) as viewed in the tank longitudinal direction increases from both sides of the gas passage portion (37) in the tank longitudinal direction toward the gas discharge port (38) located at the middle of the tank in the tank longitudinal direction. In addition, the cross-sectional area of a region of the gas passage portion (37) corresponding to the gas outlet pipe (18) (see FIG. 1) of the falling liquid film evaporator (1) as viewed in the tank longitudinal direction is relatively small.

This variation described above can also provide advantages similar to those of the foregoing embodiment. For example, since the cross-sectional area of the gas passage portion (37) increases with decreasing distance to the gas discharge port (38), the speed at which a gas refrigerant travels in the first refrigerant tub (31) can be equalized. Thus, the liquid level of a liquid refrigerant gathered in a secondary liquid reservoir (33) is also equalized. This can substantially prevent the liquid refrigerant from being carried away from the gas discharge port (38) to the outside of the first refrigerant tub (31) together with the gas refrigerant. In addition, since the cross-sectional area of the region of the gas passage portion (37) corresponding to the gas outlet pipe (18) of the falling film evaporator (1) is relatively small, the cross-sectional area of the gas outlet pipe (18) of the falling liquid film evaporator (1), that is, the cross-sectional area of a pipe (42) extending toward a compressor (41) can be set to be larger. This can improve the performance of a refrigeration apparatus including the falling liquid film evaporator (1).

Other Embodiments

In the foregoing embodiment and variations, the second refrigerant tub (39) is disposed below the first refrigerant tub (31). However, for example, the secondary liquid reservoirs (33) on both sides of the primary liquid reservoir (32) may be allowed to communicate with each other below the primary liquid reservoir (32) in the first refrigerant tub (31), and the liquid refrigerant may be distributed from the communication holes (33*a*) of the secondary liquid reservoirs (33) to the heat transfer tube group (20) of the falling liquid film evaporator (1). In other words, only the first refrigerant tub (31) may be arranged in a single layer without the second refrigerant tub (39).

In the foregoing embodiment and variations, the liquid refrigerant that has overflowed the primary liquid reservoir (32) is allowed to flow into the secondary liquid reservoirs (33). However, communication holes may be formed in, for example, a boundary wall between the primary liquid reservoir (32) and each secondary liquid reservoir (33), and the liquid refrigerant may be allowed to flow from the primary liquid reservoir (32) through the communication holes into the secondary liquid reservoirs (33).

In the foregoing embodiment and variations, the gas-liquid two-phase pipe (34) is disposed above the primary liquid reservoir (32), and the gas-liquid two-phase refrigerant is released downward to the primary liquid reservoir (32). However, for example, the gas-liquid two-phase pipe (34) may be disposed in the primary liquid reservoir (32), and the gas-liquid two-phase refrigerant may be released in the horizontal direction from both sides of the gas-liquid two-phase pipe (34) in the tank lateral direction.

In the foregoing embodiment and variations, the liquid reservoir section (32, 33) of the first refrigerant tub (31) includes the primary liquid reservoir (32) into which the gas-liquid two-phase refrigerant flows, and the secondary liquid reservoirs (33) into each of which the liquid refrigerant separated from the gas refrigerant by the primary liquid reservoir (32) flows. However, the liquid reservoir section (32, 33) may have any configuration that enables gas-liquid separation.

While the embodiments and variations have been described above, it will be understood that various changes in form and details can be made without departing from the spirit and scope of the claims. The above embodiment and variations may be appropriately combined or replaced as long as the functions of the target of the present disclosure are not impaired. In addition, the expressions of "first," "second," . . . described above are used to distinguish the terms to which these expressions are given, and do not limit the number and order of the terms.

INDUSTRIAL APPLICABILITY

As can be seen from the foregoing description, the present disclosure is useful for a liquid refrigerant distributor and a falling liquid film evaporator.

EXPLANATION OF REFERENCES

1 Falling Liquid Film Evaporator
10 Tank
11 Shell
12*a* Head
12*b* Head
14 Heating Medium Inlet Pipe
15 Heating Medium Outlet Pipe
17 Refrigerant Inflow Pipe
18 Gas Outlet Pipe
19 Liquid Outlet Pipe
20 Heat Transfer Tube Group
21 Heat Transfer Tube
30 Liquid Refrigerant Distributor
31 First Refrigerant Tub
32 Primary Liquid Reservoir
33 Secondary Liquid Reservoir
33*a* Communication Hole
34 Gas-Liquid Two-Phase Pipe
34*a* Holes
34*b* Introduction Port
35 Separation Accelerator
36 Droplet Collector
37 Gas Passage Portion
38 Gas Discharge Port
39 Second Refrigerant Tub
39*a* Communication Hole
41 Compressor
42 Pipe
SS Shell Space

The invention claimed is:

1. A liquid refrigerant distributor for use in a falling liquid film evaporator, the liquid refrigerant distributor comprising:

a gas-liquid two-phase pipe through which a gas-liquid two-phase refrigerant flows; and a first refrigerant tub including a liquid reservoir section into which the gas-liquid two-phase refrigerant flows from the gas-liquid two-phase pipe, the first refrigerant tub further including a droplet collector configured to collect droplets contained in a gas refrigerant separated by the liquid reservoir section, wherein the droplet collector is provided, as a separate element from the gas-liquid two-phase pipe, above the liquid reservoir section inside the first refrigerant tub, and the droplet collector is a mesh structure.

2. The liquid refrigerant distributor of claim 1, wherein the gas-liquid two-phase pipe releases the gas-liquid two-phase refrigerant downward to the liquid reservoir section.

3. The liquid refrigerant distributor of claim 2, further comprising a second refrigerant tub disposed below the first refrigerant tub, wherein the liquid reservoir section has a communication hole that allows the liquid refrigerant to fall to the second refrigerant tub, and the liquid refrigerant that has fallen to the second refrigerant tub is distributed to a heat transfer tube group of the falling liquid film evaporator.

4. The liquid refrigerant distributor of claim 1, wherein a bottom of the gas-liquid two-phase pipe has a perforated metal structure with a plurality of holes, and an area proportion of the holes in the perforated metal structure increases with increasing distance from an introduction port of the gas-liquid two-phase pipe for the gas-liquid two-phase refrigerant.

5. The liquid refrigerant distributor of claim 4, further comprising a second refrigerant tub disposed below the first refrigerant tub, wherein the liquid reservoir section has a communication hole that allows the liquid refrigerant to fall to the second refrigerant tub, and the liquid refrigerant that has fallen to the second refrigerant tub is distributed to a heat transfer tube group of the falling liquid film evaporator.

6. The liquid refrigerant distributor of claim 1, wherein the liquid reservoir section includes a primary liquid reservoir into which the gas-liquid two-phase refrigerant flows, and a secondary liquid reservoir into which a liquid refrigerant separated from the gas refrigerant by the primary liquid reservoir flows, and the secondary liquid reservoir is disposed on at least one side of the primary liquid reservoir.

7. The liquid refrigerant distributor of claim 6, wherein the secondary liquid reservoir is configured to gather the liquid refrigerant that has overflowed the primary liquid reservoir.

8. The liquid refrigerant distributor of claim 6, further comprising a second refrigerant tub disposed below the first refrigerant tub, wherein the liquid reservoir section has a communication hole that allows the liquid refrigerant to fall to the second refrigerant tub, and the liquid refrigerant that has fallen to the second refrigerant tub is distributed to a heat transfer tube group of the falling liquid film evaporator.

9. The liquid refrigerant distributor of claim 6, wherein the primary liquid reservoir includes a separation accelerator configured to accelerate gas-liquid separation of the gas-liquid two-phase refrigerant.

10. The liquid refrigerant distributor of claim 9, wherein the separation accelerator is a mist eliminator.

11. The liquid refrigerant distributor of claim 9, wherein the separation accelerator is disposed in an entirety or an upper portion of the primary liquid reservoir to be adjacent to a lower portion of the gas-liquid two-phase pipe.

12. The liquid refrigerant distributor of claim 9, wherein the separation accelerator is disposed in a lower portion or each of both side portions of the primary liquid reservoir.

13. The liquid refrigerant distributor of claim 1, further comprising a second refrigerant tub disposed below the first refrigerant tub, wherein the liquid reservoir section has a communication hole that allows the liquid refrigerant to fall to the second refrigerant tub, and the liquid refrigerant that has fallen to the second refrigerant tub is distributed to a heat transfer tube group of the falling liquid film evaporator.

14. The liquid refrigerant distributor of claim 7, further comprising a second refrigerant tub disposed below the first refrigerant tub, wherein the liquid reservoir section has a communication hole that allows the liquid refrigerant to fall to the second refrigerant tub, and the liquid refrigerant that has fallen to the second refrigerant tub is distributed to a heat transfer tube group of the falling liquid film evaporator.

15. The liquid refrigerant distributor of claim 1, wherein the first refrigerant tub includes a gas passage portion through which the gas refrigerant separated by the liquid reservoir section is passed, and a gas discharge port through which the gas refrigerant that has passed through the gas passage portion is discharged from the first refrigerant tub.

16. The liquid refrigerant distributor of claim 1, wherein the droplet collector is a mist eliminator.

17. The liquid refrigerant distributor of claim 1, wherein the droplet collector is adjacent to a side portion or an upper portion of the gas-liquid two-phase pipe.

18. The falling liquid film evaporator comprising the liquid refrigerant distributor of claim 1.

19. The liquid refrigerant distributor of claim 1, wherein a gas passage portion through which the gas refrigerant is passed is provided inside the first refrigerant tub.

20. The liquid refrigerant distributor of claim 19, wherein the gas passage portion is provided above the mesh structure.

21. A liquid refrigerant distributor for use in a falling liquid film evaporator, the liquid refrigerant distributor comprising:

a gas-liquid two-phase pipe through which a gas-liquid two-phase refrigerant flows; and a first refrigerant tub including a liquid reservoir section into which the gas-liquid two-phase refrigerant flows from the gas-liquid two-phase pipe, the first refrigerant tub further including a droplet collector configured to collect droplets contained in a gas refrigerant separated by the liquid reservoir section, and the first refrigerant tub includes a gas passage portion, separate from the droplet collector through which the gas refrigerant separated by the liquid reservoir section is passed, and a gas discharge port through which the gas refrigerant that has passed through the gas passage portion is discharged from the first refrigerant tub, wherein a cross-sectional area of the gas passage portion increases toward the gas discharge port.

22. The liquid refrigerant distributor of claim 21, wherein the cross-sectional area of a region of the gas passage portion corresponding to a gas outlet pipe of the falling liquid film evaporator is relatively small.

* * * * *